US010569377B2

(12) United States Patent
Robinson et al.

(10) Patent No.: US 10,569,377 B2
(45) Date of Patent: Feb. 25, 2020

(54) ROBOTIC SHARPENING SYSTEM

(71) Applicant: Omnisharp, LLC, Round Rock, TX (US)

(72) Inventors: Jacob Robinson, Round Rock, TX (US); Lynn Sarcione, Austin, TX (US); Russell Aldridge, Austin, TX (US); Marc Christenson, Austin, TX (US); Mathius Jules, Pflugerville, TX (US); Joshua Bennett, Tucson, AZ (US)

(73) Assignee: Omnisharp, LLC, Austin, TX (US)

( * ) Notice: Subject to any disclaimer, the term of this patent is extended or adjusted under 35 U.S.C. 154(b) by 59 days.

(21) Appl. No.: 15/898,278

(22) Filed: Feb. 16, 2018

(65) Prior Publication Data

US 2018/0236623 A1 Aug. 23, 2018

Related U.S. Application Data

(60) Provisional application No. 62/460,762, filed on Feb. 18, 2017.

(51) Int. Cl.

| | |
|---|---|
| ***B24B 49/12*** | (2006.01) |
| ***B24B 3/40*** | (2006.01) |
| ***B24B 53/007*** | (2006.01) |
| ***B24B 41/06*** | (2012.01) |
| ***B24B 49/16*** | (2006.01) |

(52) U.S. Cl.

CPC ..... *B24B 3/40* (2013.01); *B24B 41/066* (2013.01); *B24B 49/12* (2013.01); *B24B 49/16* (2013.01); *B24B 53/007* (2013.01)

(58) Field of Classification Search

CPC ..... B24B 49/12; B24B 3/54
USPC ..... 451/5, 6, 8–10, 45, 28; 76/82
See application file for complete search history.

(56) References Cited

U.S. PATENT DOCUMENTS

| | | | | |
|---|---|---|---|---|
| 8,915,766 | B1 * | 12/2014 | Kolchin | B24B 3/54 451/45 |
| 10,272,535 | B1 * | 4/2019 | Lyons | B24B 49/04 |
| 2011/0281503 | A1 * | 11/2011 | Knecht | B24B 3/54 451/5 |

* cited by examiner

*Primary Examiner* — Robert A Rose
(74) *Attorney, Agent, or Firm* — Eversheds Sutherland (US) LLP

(57) ABSTRACT

An apparatus, system, and a method for sharpening a cutting tool. The system sharpens cutting tools by manipulating the tool, measuring the three dimensional profile of the tool, and then grinding the tool. The apparatus consists of a robot capable of six degrees of motion, a gripping mechanism, a force-torque sensor capable of at least two directions of force and/or torque, a three dimensional scanning subsystem, a loading subsystem, a user interface, an initial orientation scan subsystem, a data processing and robot control subsystem, and at least one grinding system comprising two counter-rotating grinding wheels. The method automates the grinding process so that dull cutting tools can be placed into the loading system, sharpened by the system, and then ejected fully honed.

6 Claims, 14 Drawing Sheets

ROBOTIC SHARPENING SYSTEM

BACKGROUND OF THE INVENTION

This utility application claims priority to U.S. Provisional Patent Application Ser. No. 62/460,762, filed Feb. 18, 2017, which is incorporated herein by reference for all purposes.

There have been numerous attempts to roboticize the process of sharpening tools. In the food industry and, particularly in the meat processing industry, there is the requirement for the use of hundreds of sharp knives to cut and butcher meats. These knives must be kept sharp for the cutting process to be effective. As knives become dull or chipped in use, they must be removed from use and sharpened and shaped before being returned to the operation. The time and effort to sharpen such tools is considerable and requires highly skilled operators.

The present invention discloses an apparatus, a system, and a method for rapidly and accurately sharpening cutting tools integrating a commercial knife sharpener and a robotic operator which sharpens both sides of the knife cutting edge simultaneously.

SUMMARY OF THE INVENTION

The present invention is a system used to sharpen cutting tools of various sizes and shapes. The device sharpens simultaneously both sides of the cutting edges of cutting tools by manipulating the tool, measuring the three dimensional profile of the tool, and then grinding the tool. It consists of a robot capable of six degrees of motion, a gripping mechanism, a force-torque sensor subsystem capable of sensing at least two directions of force and/or torque, a three dimensional scanning subsystem, a loading subsystem, a user interface, an initial orientation scan subsystem, a data processing and robot control subsystem, and at least one grinding system comprising two counter-rotating grinding wheels. This device automates the grinding process so that dull cutting tools may be placed into the loading system, sharpened by the system, and then ejected fully honed.

DETAILED DESCRIPTION OF A PREFERRED EMBODIMENT

Figure 1:
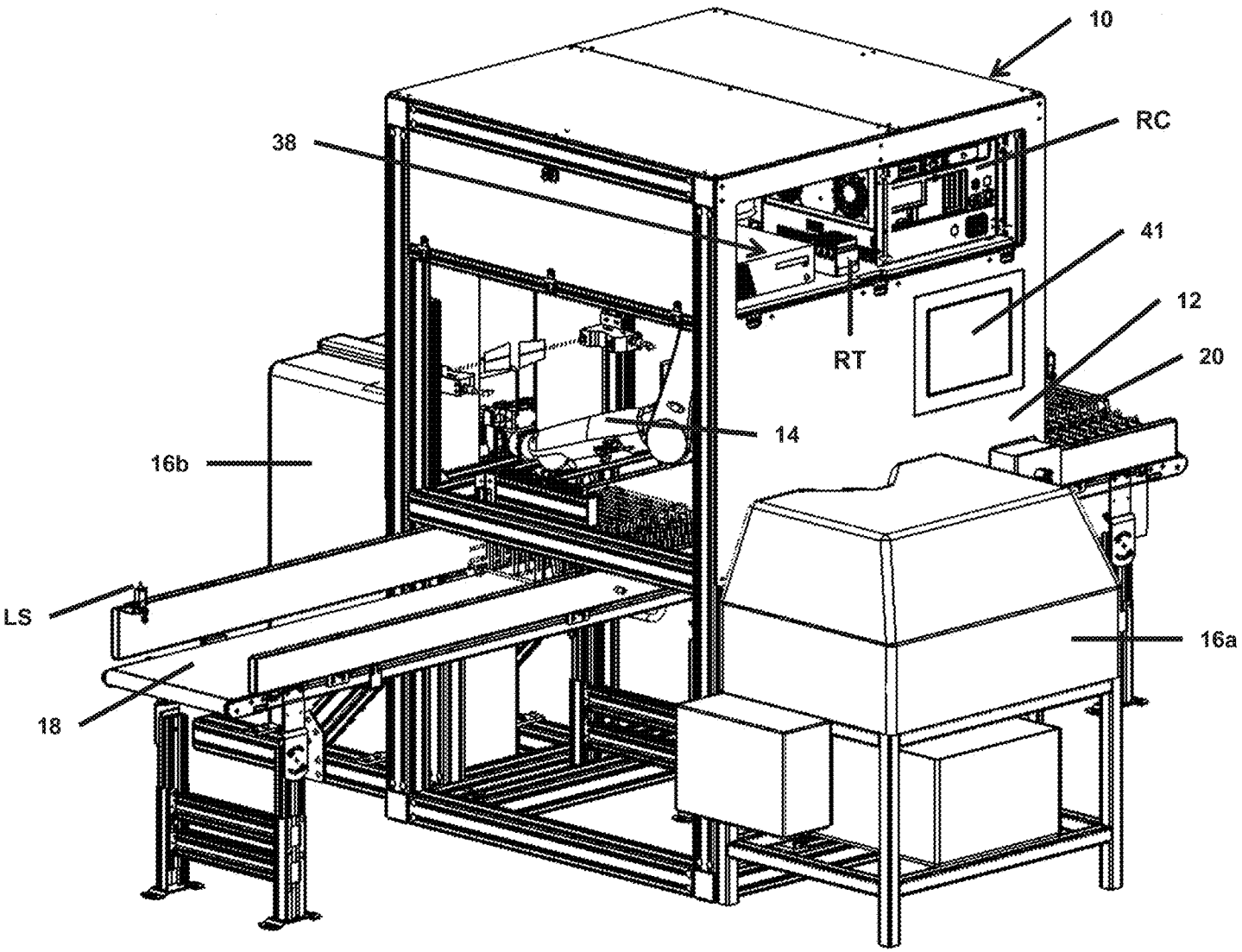
FIG. 1 illustrates a perspective view of the major components of the present invention.
Figure 1A:
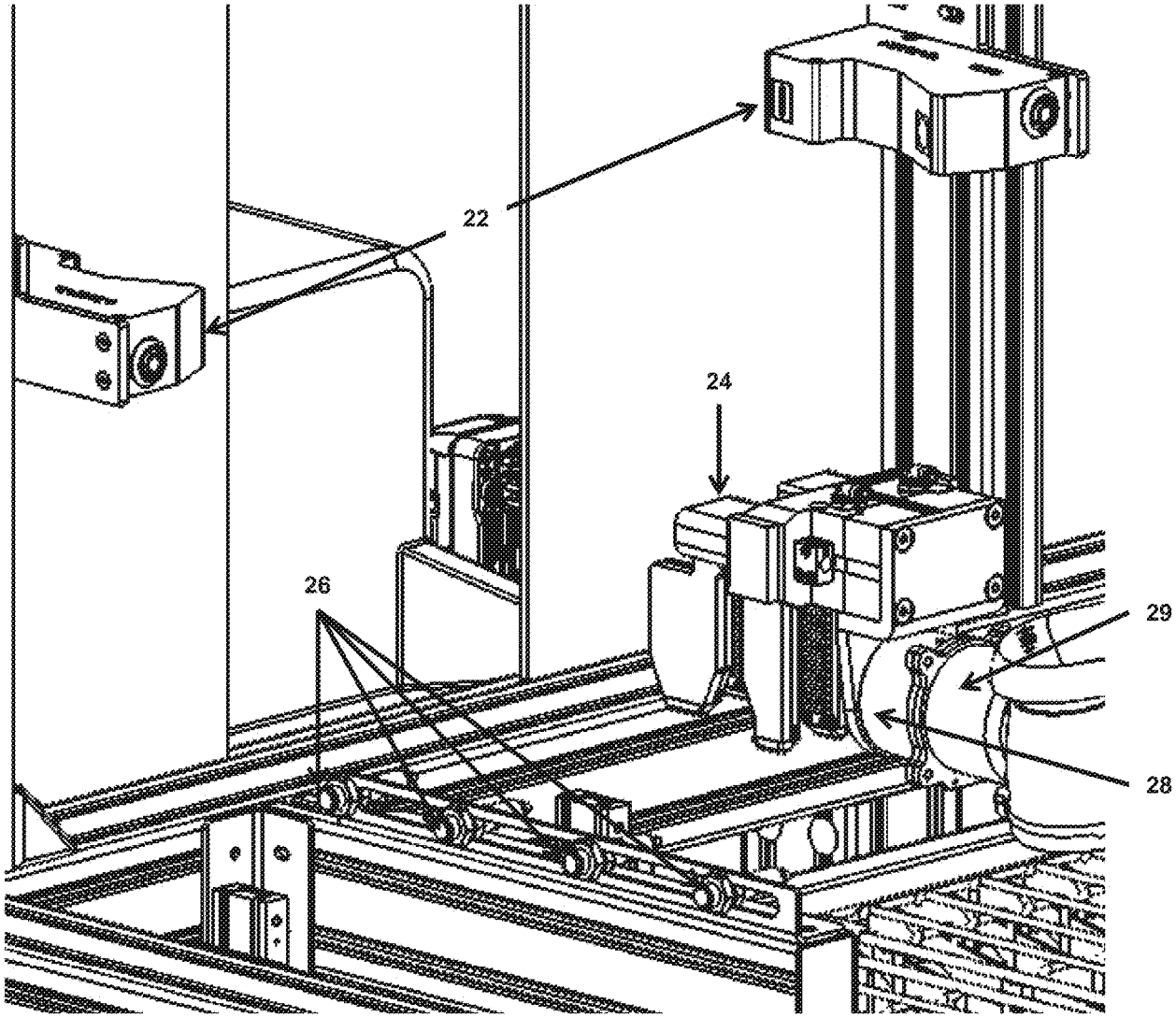
FIG. 1A illustrates in more detail various components of the present invention.

FIG. 1 is an overall view of the system 10 illustrating a robot enclosure 12, a robot 14, grinding machines 16*a* and 16*b*, a conveyor belt 18, and knife containers 20. FIG. 1A illustrates in more detail various components of the system, including the 3-D scanner 22, the knife gripper 24, an array of proximity sensors 26 (which does an initial scan) and force torque sensor 28. In the present system the robot sharpens both sides of the knife's edge simultaneously.

Figure 2:
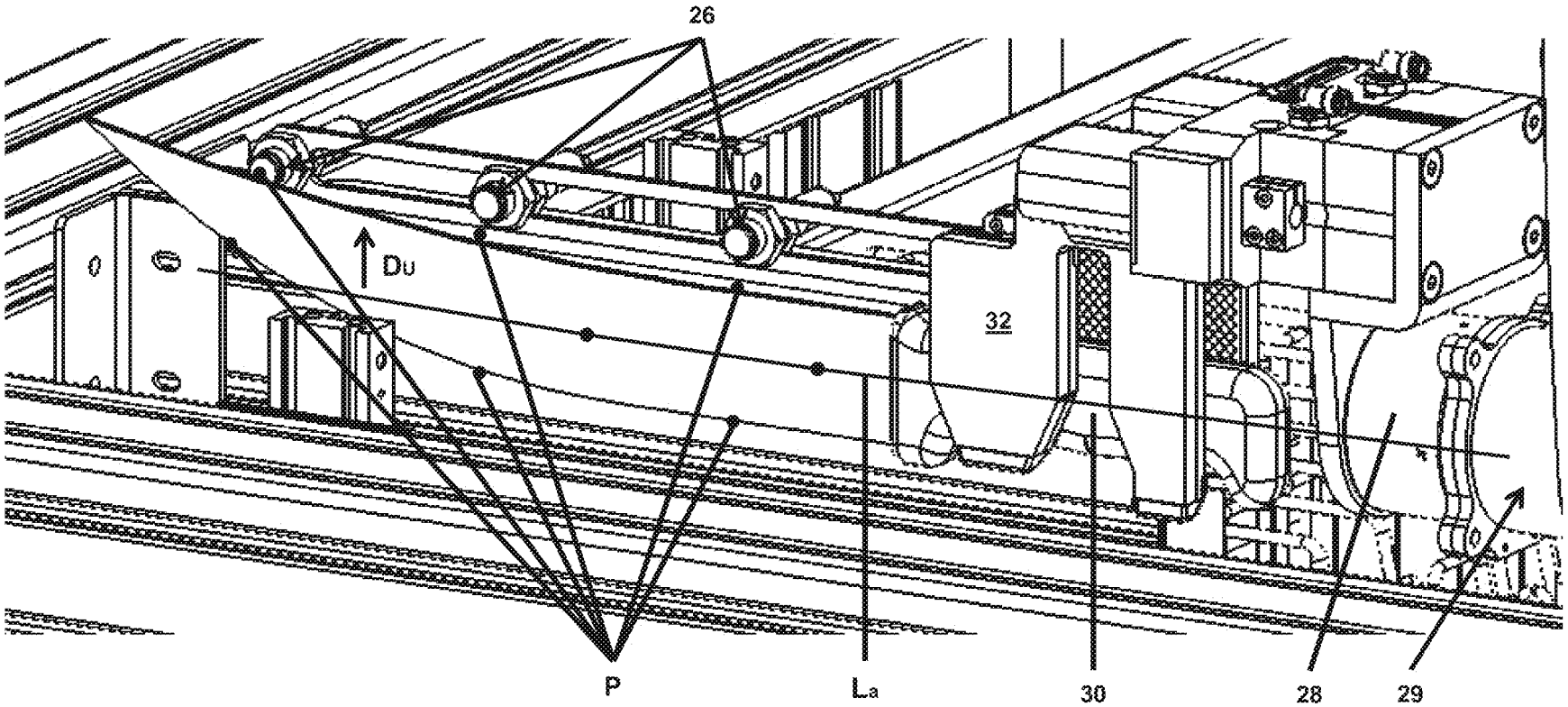
FIG. 2 shows the robot gripper head holding a knife such that both cutting edges are exposed for profiling.

Operation of the automated sharpening system 10 begins as the user loads the system with the cutting tools 30 placed in a container 20 that holds the tools in a consistent orientation. Once the system is initially loaded, the operator begins the grinding process, and the conveyor 18 moves the tool container 20 such that the first tool 30 is positioned in the pick-up location. When the tool is in the pick-up location, the robot 14 grasps the tool 30 with the gripper head 32, as shown in FIG. 2, such that the knife cutting edges 40 (on opposite sides of the knife) (See FIG. 3) to be sharpened remain exposed. Then the robot 14 performs a linear move past an array of proximity sensors 26 placed on a line perpendicular to the upward direction $D_u$ of motion of the blade 35 and parallel to the longitudinal axis $L_a$ of the tool edge. This move captures points P along both the bottom edge 31 and the top edge 37 of the tool (the number of points equal to the number of proximity sensors in the array). This initial shape determination of the tool (Rough Scan Shape) is then used to determine the position and orientation needed to bring the tool into the center of the focal area 36 of the three dimensional scanning system (see FIG. 3).

Figure 3:
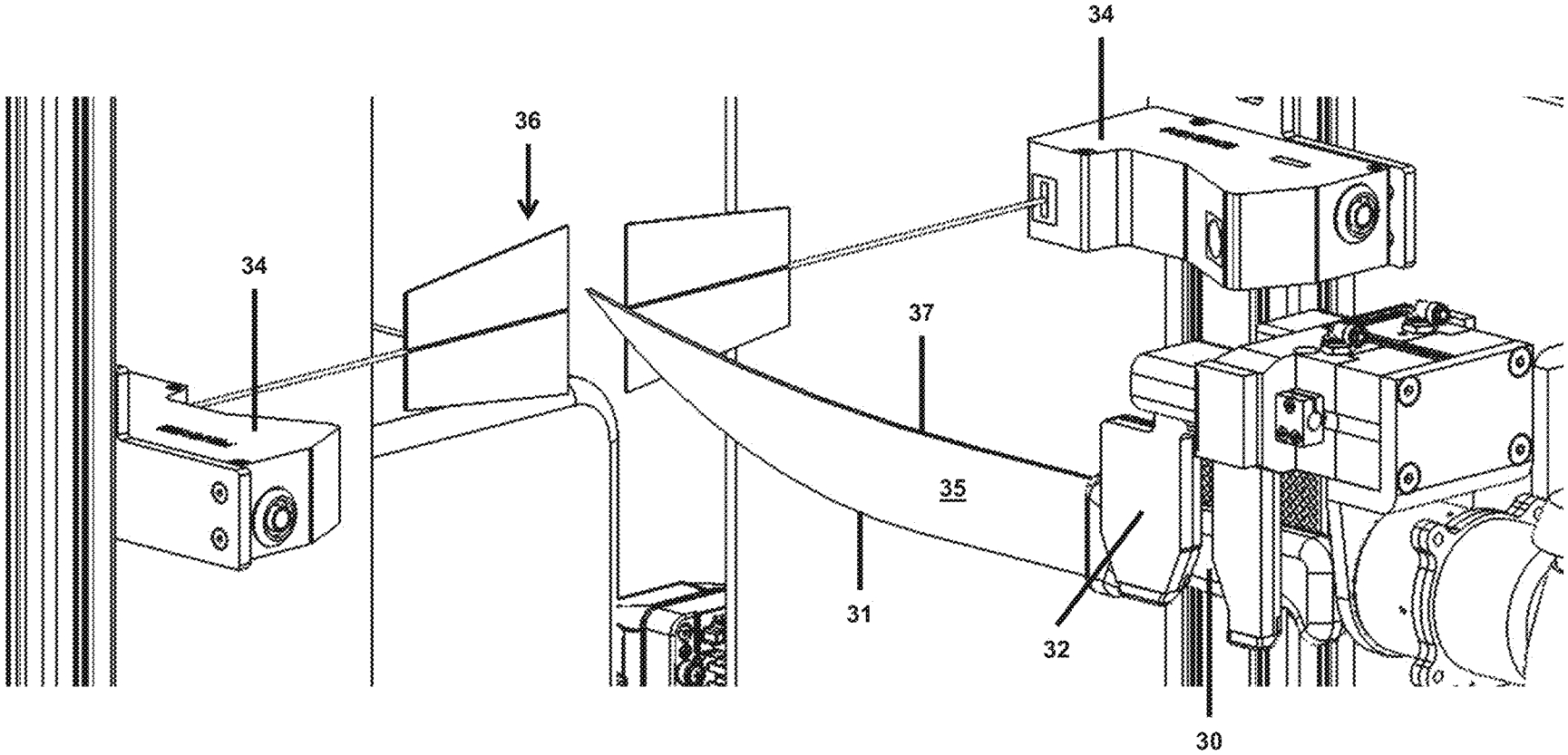
FIG. 3 shows the knife being moved to the 3-D scanning subsystem to determine the fine grind scan profile.

While the term "3-D scanner system" is used throughout this description, one of ordinary skill in the art will understand that each scanner is a two-dimensional profilometer 34 used in conjunction with the movement of the knife through the focal area 36 (See FIG. 3).

The robot 14, such as a Kuka 6-axis Agilus series robot, then moves the tool 30 to the three dimensional scanning area 36 and performs a three dimensional scan of the tool 30 (Fine Scan Grind Profile). Using the data from this scan, concerning the shape of the knife edges, the control system 38 (FIG. 1) first determines whether hollow grinding is needed.

Figure 4:
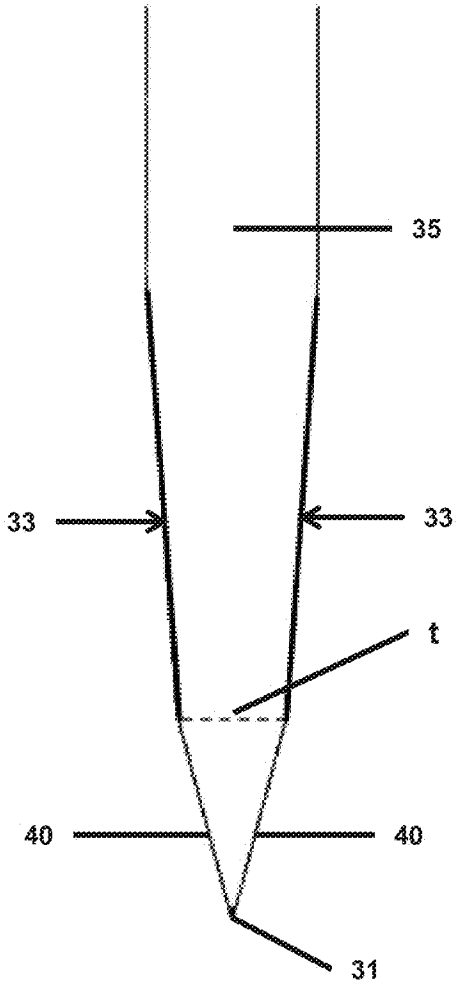
FIG. 4 illustrates a cross-sectional view of a knife blade showing both cutting edges, and the hollow grind and hone grind area.

FIG. 4 illustrates a cross sectional view of a typical knife blade showing the body of the blade 35, the hollow grind edge 33 and the honed edge 40. These terms are well understood by those of ordinary skill in the art. If the thickness t of the tool near the edge is larger than a preset threshold (determined by the type of knife and user preferences) and a hollow grinding machine 16*a* is installed, then the robot 14 will proceed to hollow grind the cutting tool followed by honing the tool on the honer grinding machine 16*b* (understood to be easily accessible to the robot). If the thickness t is less than the threshold (i.e., no hollow grind necessary), then the robot will proceed directly to the honer machine 16*b*. The three dimensional scan data is then used to determine the robot grind path using the measured tool edge profile (see FIG. 5). If the scan data results in a tool 30 that is out of range or has been ground down to the limit, the robot 14 will move the tool 30 to a reject location for collection and proceed to load another tool. Otherwise, it will continue with the force controlled grind described below.

Once the robot 14 has positioned the tool 30 over the grinding wheels 42*a* and 42*b* (FIG. 5A), the tool 30 is lowered using a force controlled move that stops when the force-torque sensor 28 (FIG. 1A) on the robot wrist 29 (FIG. 2) registers a force above a certain value. For example (FIGS. 6 and 6A), the robot 14 would begin in the orientation necessary to place the tip 50 of the tool on the grinding stones, but offset from the grinding stones by 30 mm. Then the robot 14 would lower the tool until the force torque sensor 28 registered 0.5 N (Newtons) at which point it would start moving through the regular grind motion seen in FIG. 5.

Figure 5:
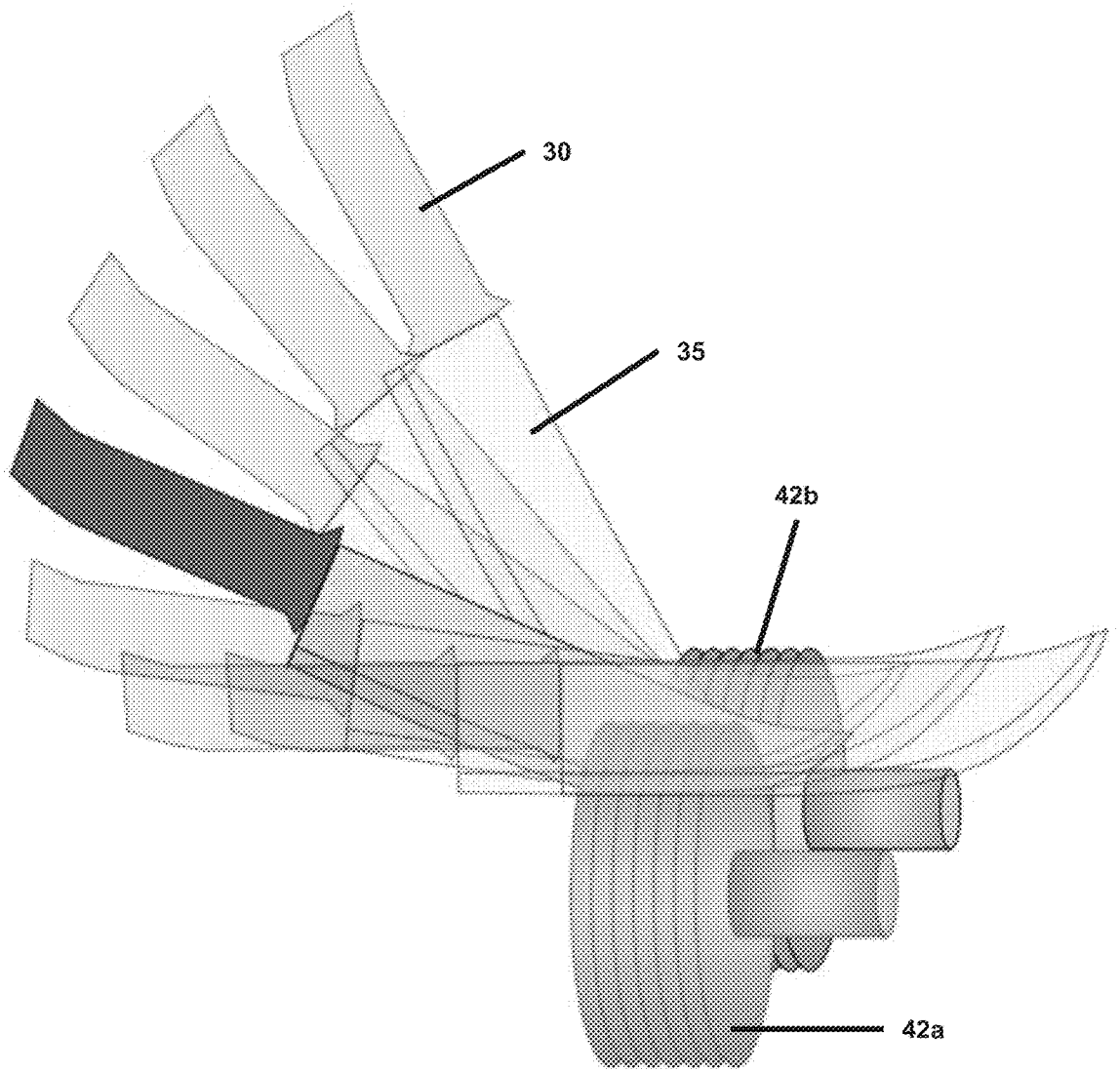
FIG. 5 illustrates the grind path of a single knife through the grinding stone ensuring that the contacting point along the edge profile always remains tangent to the grinding surface.
Figure 5A:
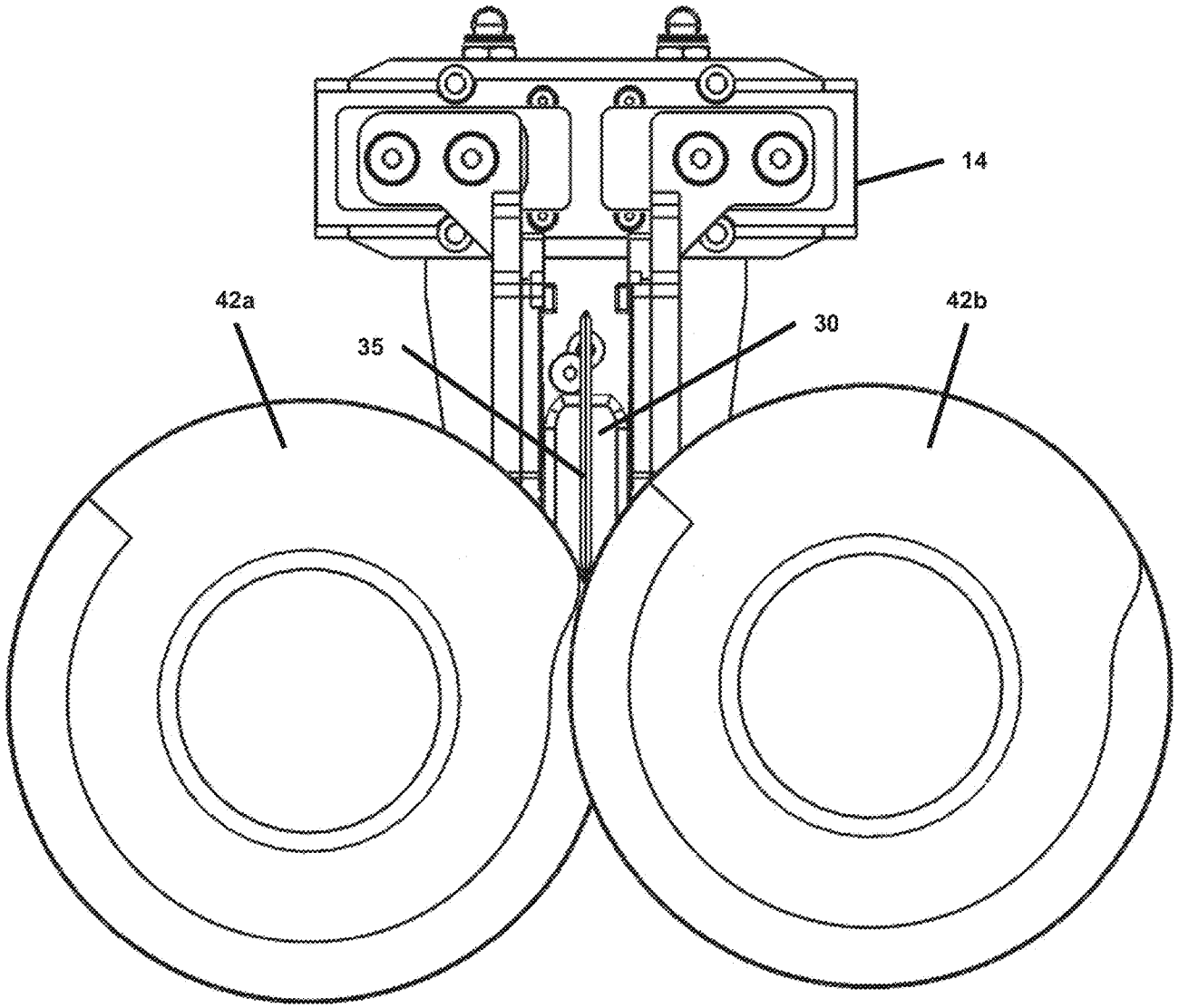
FIG. 5A illustrates the knife positioned over the grinding wheels.
Figure 6:
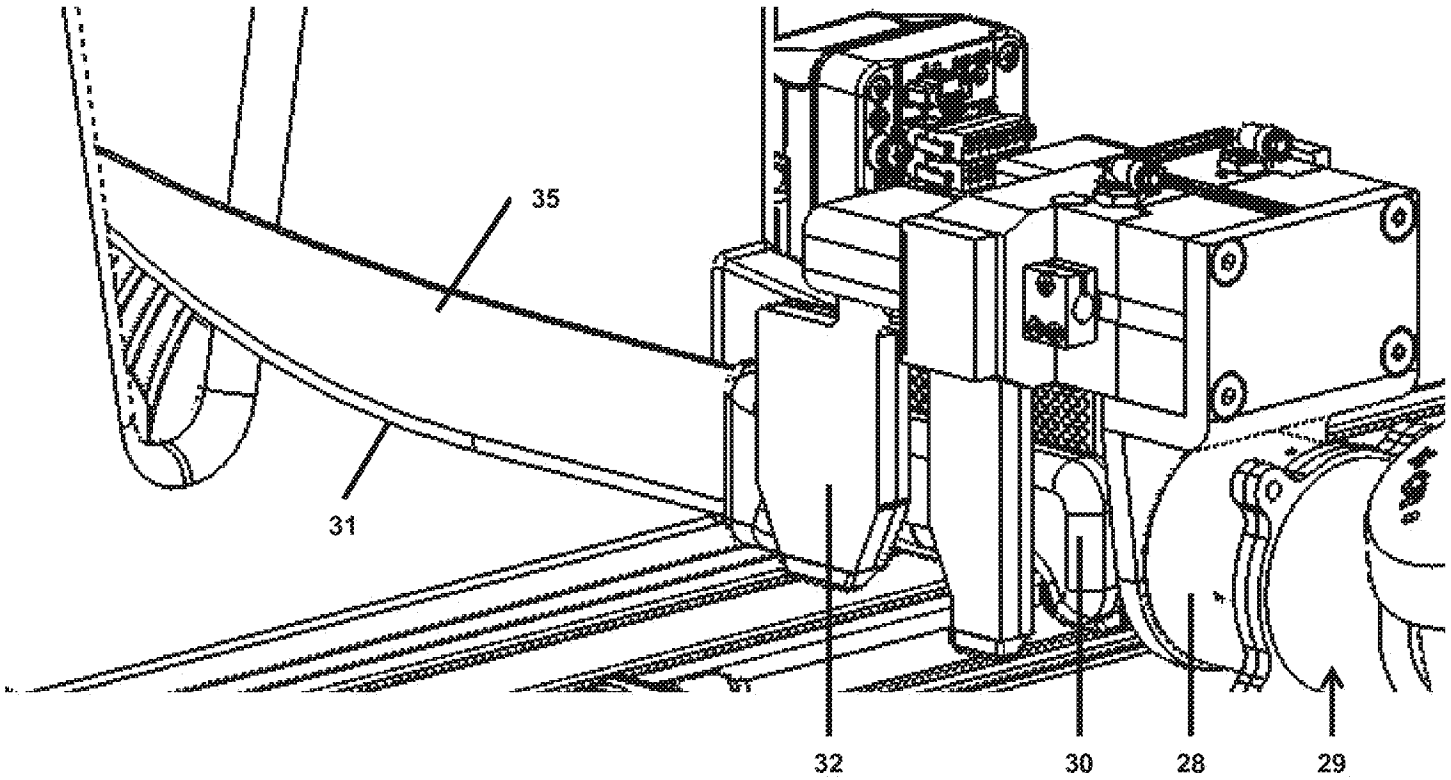
FIG. 6 shows the knife positioned above the grinding wheels by the robot.
Figure 6A:
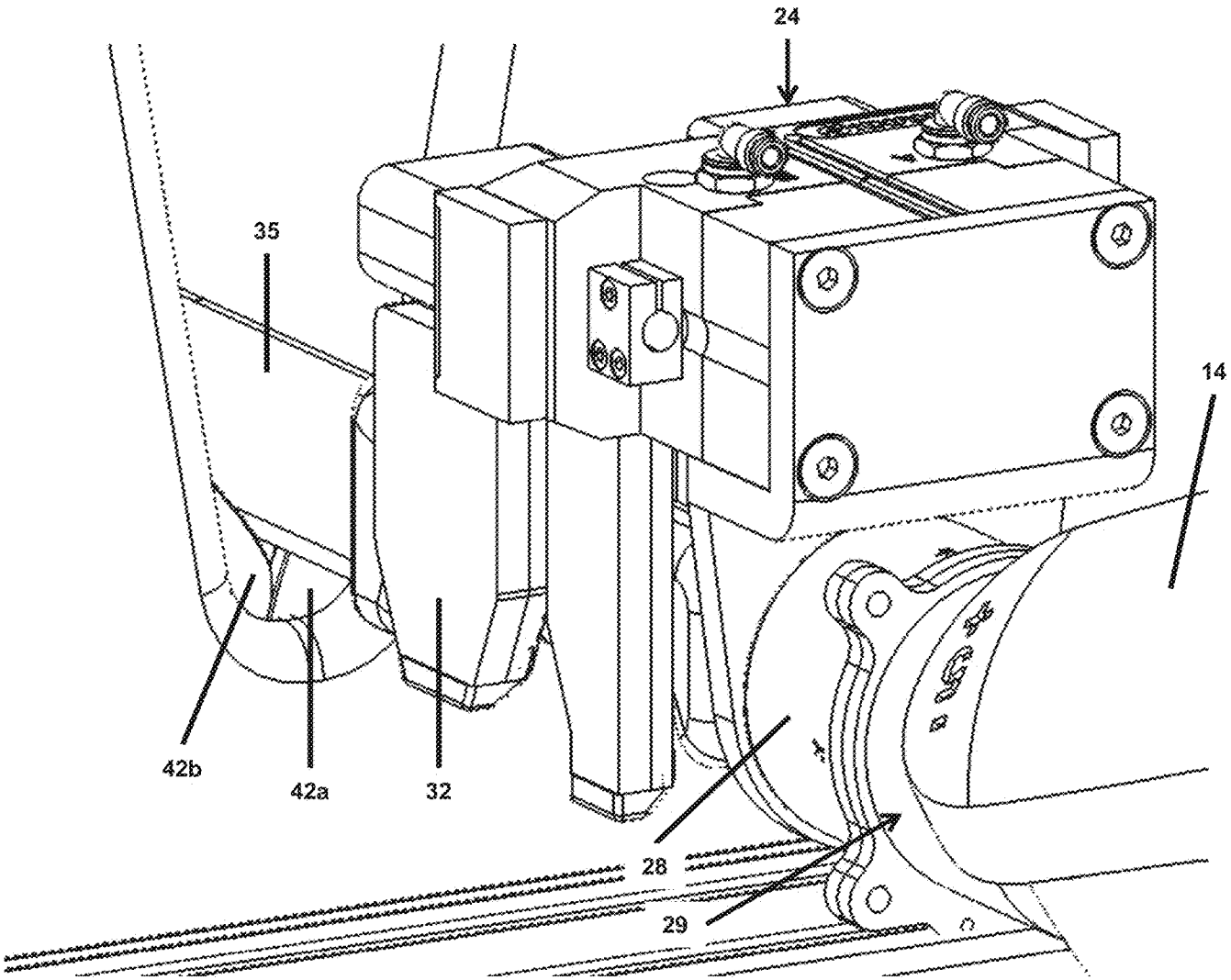
FIG. 6A shows the knife urged through the grinding path between the grinding wheels.
Figure 7:
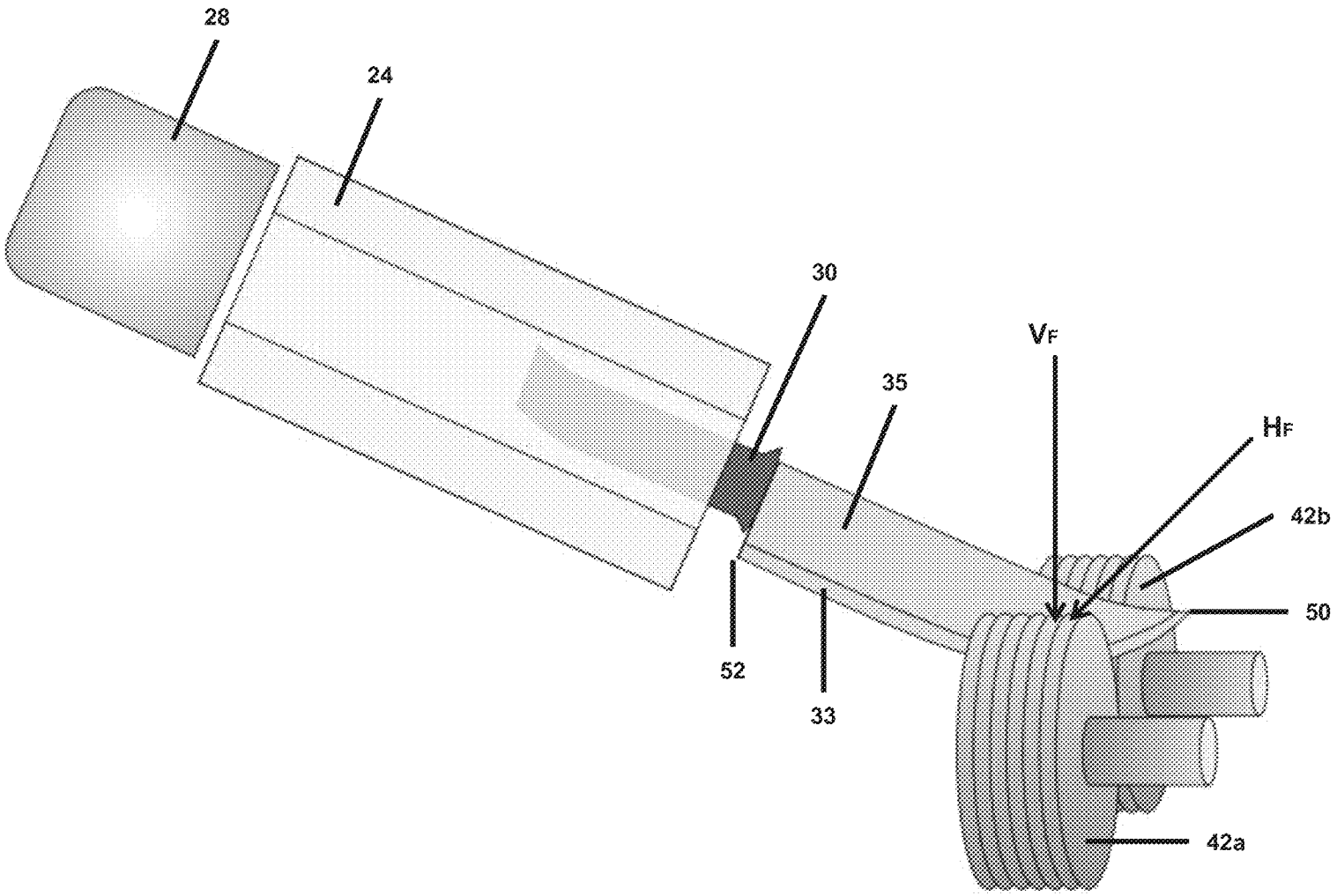
FIG. 7 illustrates the vertical grinding force being maintained using the force-torque sensor.

From there the robot moves through the grinding path which ensures that the contacting point along the edge profile is always tangent to the grinding surface (FIG. 5). Throughout the grinding move, the vertical grinding force $V_F$ (FIG. 7) is maintained using the force-torque sensor 28. Any measured deviations from the desired grinding force are actively countered with an applied torque from the robot 14 using a proportional-integral-derivative (PID) control algorithm (See FIG. 8) within the real-time controller RT. The difference between an expected value and a measured value is used to maintain a certain vertical force $V_F$ (See FIG. 8). While the vertical force $V_F$ is being controlled, any variation in the horizontal position of the grinding stones will be seen as a $H_F$ and will be compensated for with a PID control loop (FIG. 8) around the horizontal force. If the horizontal force $H_F$ deviates from the desired value (usually zero) then the robot will adjust by moving the knife blade 35 in the horizontal direction. This control method is applied through a preset number of grinding passes from tip 50 to heel 52 and back to tip 50 at a set velocity. Thus, allowing the operator to simultaneously sharpen both sides 40 of the knife edge yields a better knife edge which may not have to be deburred or even polished.

Figure 8:
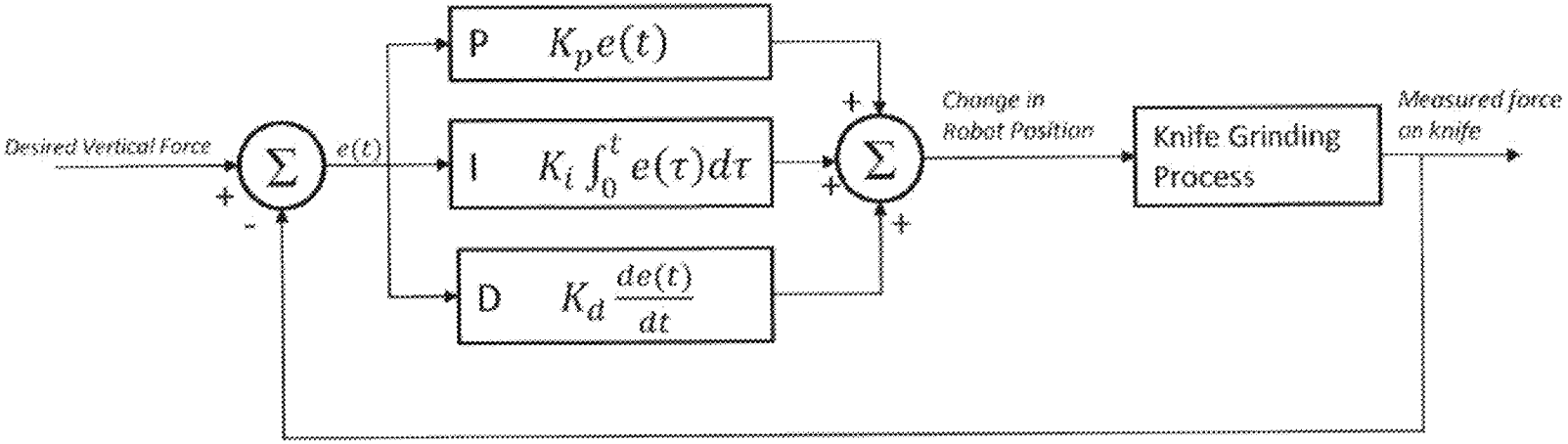
FIG. 8 illustrates the PID control loop.

In order to make these corrective moves and control the motion based on the forces, the robot 14 needs to be actively controlled. This is illustrated in FIG. 8. A real-time controller RT (FIG. 1) communicates with the robot controller RC (FIG. 1) to define the robot position for every clock cycle. Since the PID control loop (FIG. 8) and force/torque data acquisition are happening on the real-time controller, the grind path calculated from the scanner data can be constantly adjusted as the points are sent to the robot controller RC.

The grinding finishes at the tip 50 and then the robot 14 moves the tool 30 off of the grinding stones 42*a* and 42*b*. The tool is then manipulated back to the holding container and deposited. The conveyor then indexes the tools forward so that the next tool is in the pick-up location. The robot then picks up the next tool and repeats the entire process of scanning and grinding.

Once a container of tools is completed it will be moved out of the robot workspace where the operator may retrieve it. This all occurs as the system 10 is continually sharpening tools and thus requires no downtime to load and unload the system. If the system 10 is left unattended, then the tool conveyor 18 will eventually push the knife container 20 into the limit switch LS at the end of travel. When this happens the entire system pauses motion and waits for the limit switch to be released at which point it resumes operation.

Figure 9:
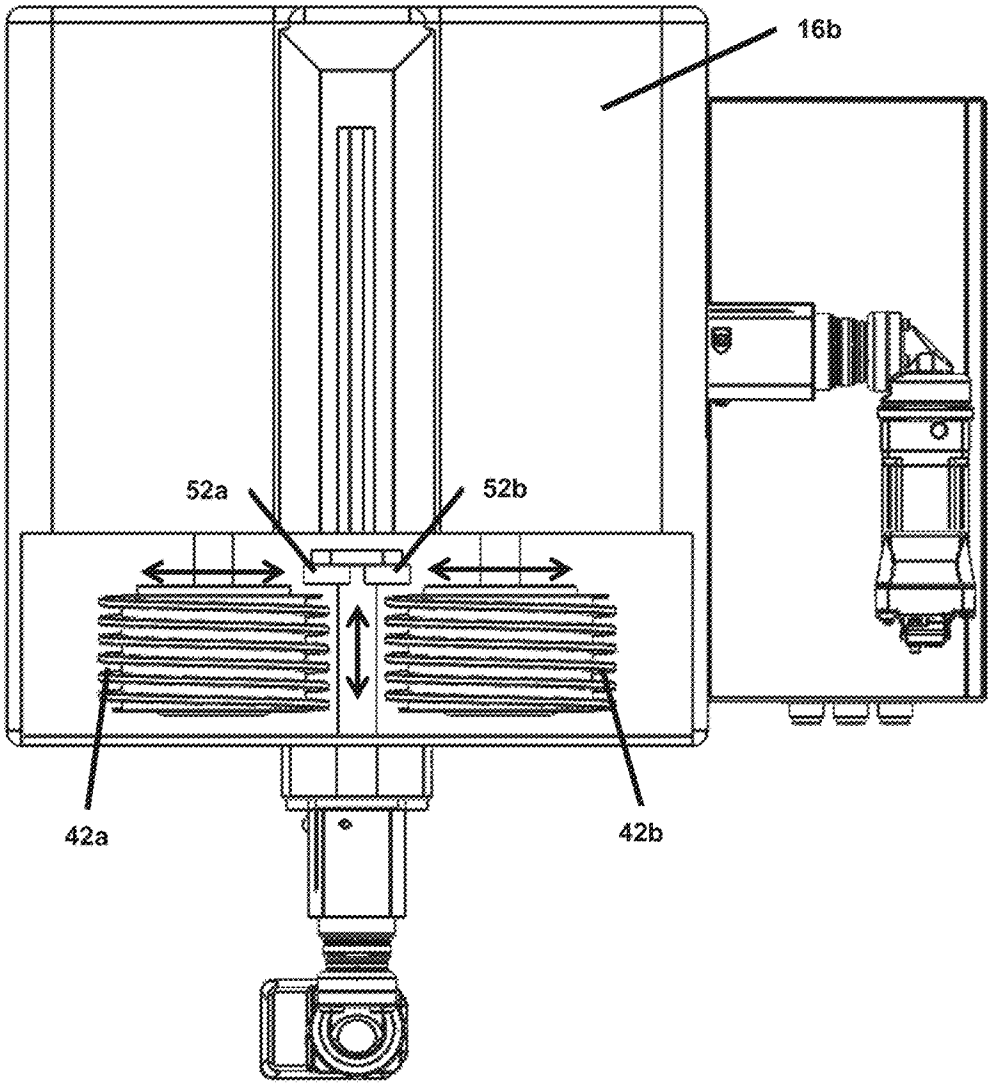
FIG. 9 illustrates a top view of the grinding stone dressing step of the present invention.
Figure 9A:
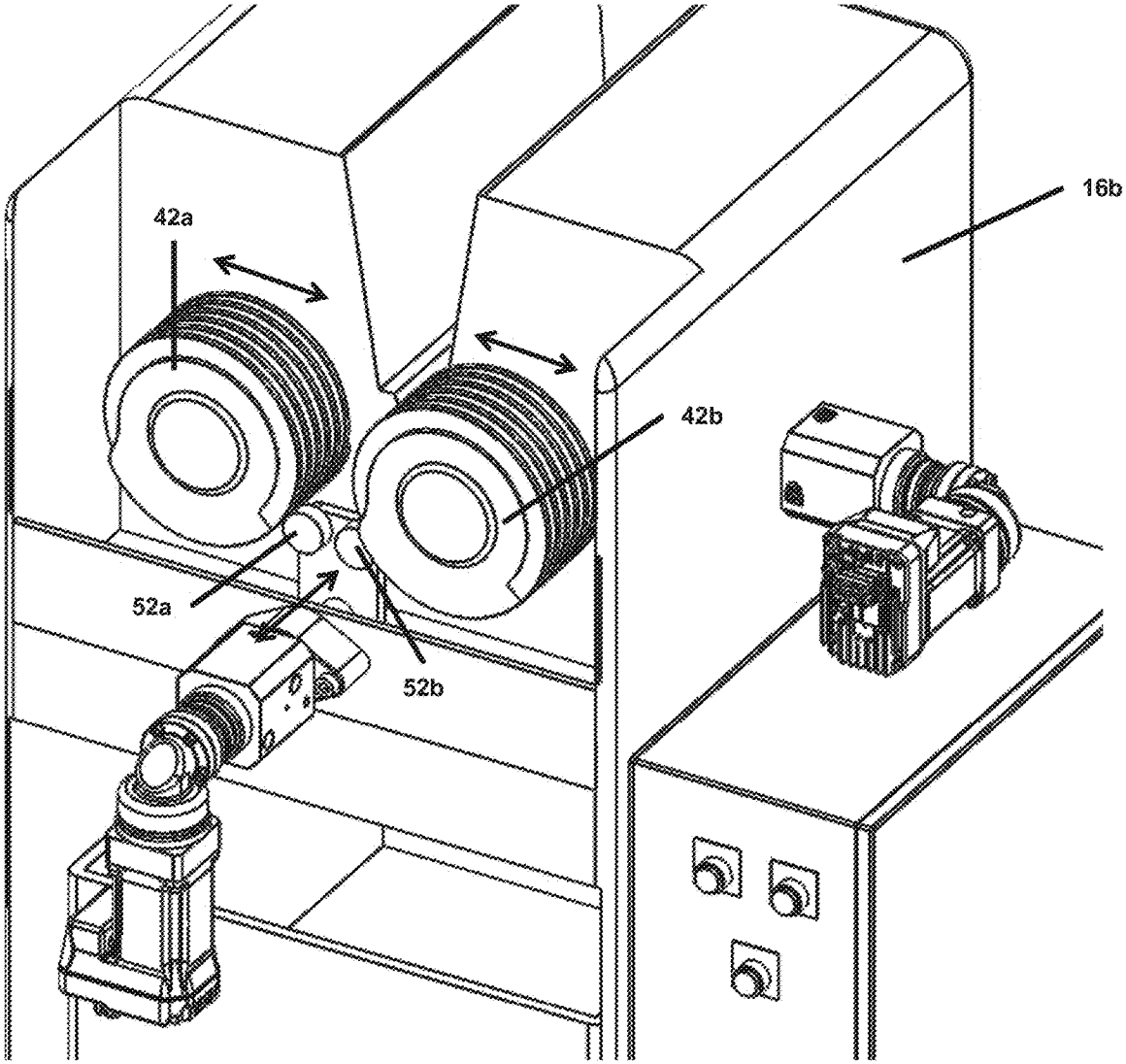
FIG. 9A shows a perspective view of the grinding stone dressing step.

After a preset number of grinds, the grinding stones 42*a* and 42*b* become filled with particles from the tools being ground. The stones must be dressed using a pair of diamond dressing stones 52*a* and 52*b*. This is done automatically using two motors that control the motion of the grinding stones and the diamond dressing stones as illustrated in FIGS. 9 and 9A. First the grinding stones are moved apart until they reach their outer limit. Then the diamond dressing stones are moved forward while the grinding stones are spinning. As the dressing stones move forward and backward they make contact with the spinning grinding stones and remove some material. Once the dressing stones have moved forward and then back to their initial position, the grinding stones move inward back to their original position, slightly adjusted for the change in diameter from the dressing. This feature ensures that the grind angle is consistent even after dressing.

The system is controlled by controller 38 via a touch screen user interface 41 (FIG. 1) that allows the operators to manually move the conveyor and the robot as well as toggle other actuators on the system. There are also a number of thresholds and settings that the user can adjust as needed. For example, the intensity of the grind can be adjusted to meet the needs of specific tools and various sharpness requirements.

Figure 10:
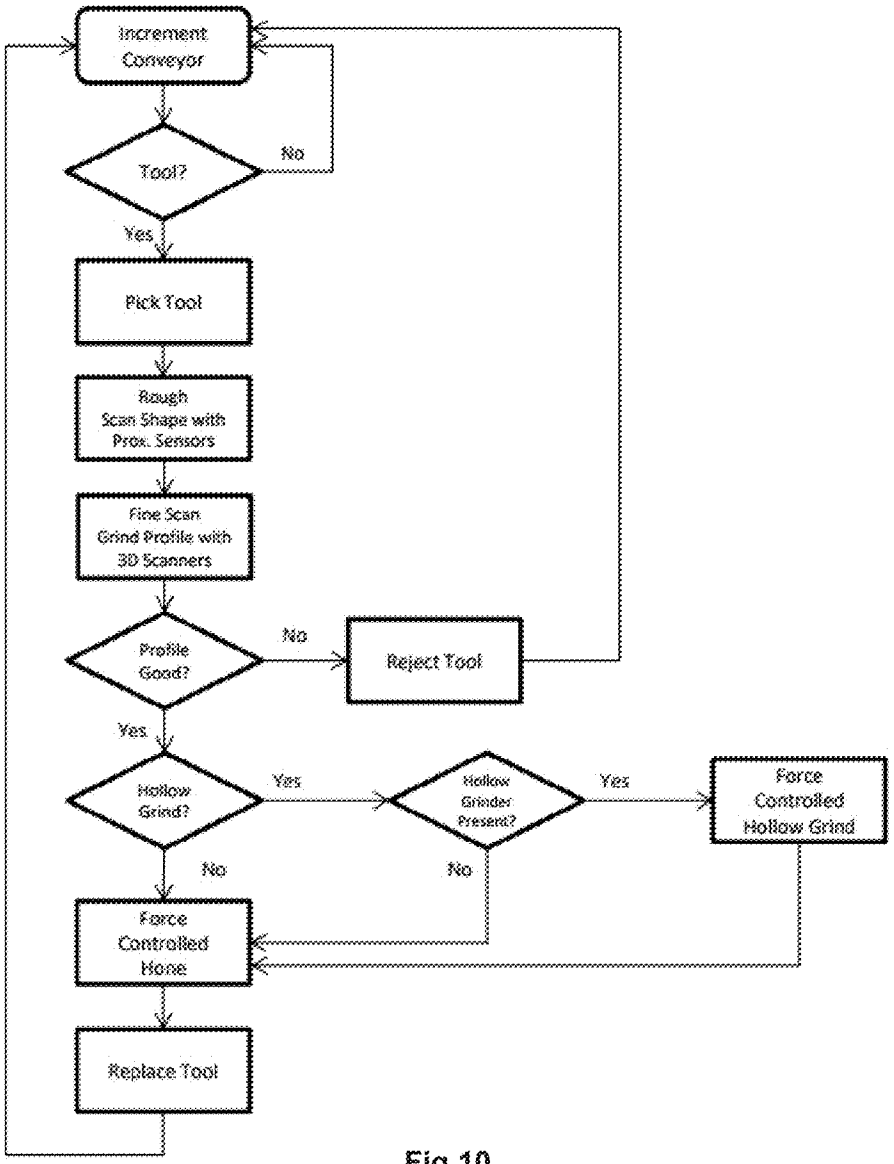
FIG. 10 illustrates a process or method flow chart for sharpening a cutting tool with the present invention.

FIG. 10 shows a process flowchart for the present inventive system.

The embodiments described herein are some examples of the current invention. Various modifications and changes of the current invention will be apparent to persons of ordinary skill in the art. Among other things, any feature described for one embodiment may be used in any other embodiment. Although the description herein is primarily in reference to systems for sharpening cutting tools, it should be understood that some embodiments of the invention may involve other types of processes for sharpening tools. The scope of the invention is defined by the attached claims and other claims that may be drawn to this invention, considering the doctrine of equivalents, and is not limited to the specific examples described herein.

We claim:

1. A system for simultaneously sharpening both sides of the cutting edge of a knife blade comprising:

an automated robot for manipulating a knife;

a grinding subsystem capable of both hollow grinding and honing said knife blade;

a control subsystem for controlling said knife through said grinding subsystem to simultaneously sharpen said both sides of the cutting edge of said knife blade, said control subsystem comprising:

a first set of proximity sensors for determining an initial shape of said knife blade;

a 3-D scanner for measuring an edge profile of said knife blade and determining a grinding path for said knife blade through said grinding subsystem;

a force-torque sensor on a wrist member of said robot for controlling said grinding path whereby a contacting point along said cutting edge is maintained tangent to a grinding surface of said grinding subsystem and maintaining a constant grinding force;

a knife delivery subsystem for delivering knives to said robot for pickup and removal by said robot.

2. The system of claim 1 wherein said control subsystem further comprises:

a real-time controller in communication with a robot controller to define the robot position and orientation; and a proportional-integral-derivative (PID) control loop programmed into said real-time controller.

3. The system of claim 2 wherein said PID control loop determines measured deviations from a desired grinding force to control applied torque from said robot wrist.

4. The system of claim 3 wherein said knife delivery subsystem further comprises:

a conveyor which indexes a knife holding container such that said knife may be moved into and out of a robot workspace.

5. The system of claim 4 further comprising:

a tool dressing subsystem for removing particles of said knife blade accumulated on grinding stones in said grinding subsystem.

6. The system of claim 3 wherein said control subsystem further comprises:

a touch screen user interface for operators to manually control said robot, said knife delivery subsystem, and the intensity of the grind.

* * * * *